US009909464B2

(12) United States Patent
Oh et al.

(10) Patent No.: US 9,909,464 B2
(45) Date of Patent: Mar. 6, 2018

(54) INTERMEDIATE PHASE ADJUSTMENT APPARATUS OF CVVT

(71) Applicants: Hyundai Motor Company, Seoul (KR); Kia Motors Corp., Seoul (KR)

(72) Inventors: Chung Han Oh, Seongnam-Si (KR); Yun Seok Kim, Yongin-Si (KR); Jong Kuk Park, Yongin-Si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 99 days.

(21) Appl. No.: 14/952,464

(22) Filed: Nov. 25, 2015

(65) Prior Publication Data

US 2017/0022851 A1 Jan. 26, 2017

(30) Foreign Application Priority Data

Jul. 24, 2015 (KR) ..... 10-2015-0105161

(51) Int. Cl.
*F01L 1/344* (2006.01)
*F01L 1/047* (2006.01)

(52) U.S. Cl.
CPC ..... *F01L 1/3442* (2013.01); *F01L 2001/0476* (2013.01); *F01L 2001/34426* (2013.01); *F01L 2001/34433* (2013.01); *F01L 2001/34463* (2013.01)

(58) Field of Classification Search
CPC ..... F01L 1/3442; F01L 2001/0476; F01L 2001/34426; F01L 2001/34433; F01L 2001/34463; F01L 2001/34423; F01L 1/267
See application file for complete search history.

(56) References Cited

U.S. PATENT DOCUMENTS 8,820,280 B2 * 9/2014 Smith ..... F01L 1/3442 123/90.15

FOREIGN PATENT DOCUMENTS

| | | | |
|---|---|---|---|
| JP | 2009-168038 | A | 7/2009 |
| KR | 1999-013625 | A | 2/1999 |
| KR | 2001-0030066 | A | 4/2001 |
| KR | 10-2009-0051577 | A | 5/2009 |
| KR | 10-2014-0002635 | A | 1/2014 |
| WO | WO 2012/047748 | A2 | 4/2012 |

* cited by examiner

*Primary Examiner* — Brandon Lee
(74) *Attorney, Agent, or Firm* — Morgan, Lewis & Bockius LLP

(57) ABSTRACT

An intermediate phase adjustment apparatus of intermediate phase continuous variable valve timing includes chambers and a diverter valve balancing oil pressure between the chambers. The chamber includes an advancing chamber and a retarding chamber formed between a rotor and a stator and supplied with oil through an oil channel. The diverter valve balances oil pressure between the chambers by sliding along an oil line through which the oil moves only in one direction between the chambers so that the oil selectively moves from a chamber having higher pressure to a chamber having lower pressure due to a pressure difference.

9 Claims, 7 Drawing Sheets

$T_{peak_retard} > T_{peak_advance}$

INTERMEDIATE PHASE ADJUSTMENT APPARATUS OF CVVT

CROSS REFERENCE TO RELATED APPLICATION

The present application claims priority of Korean Patent Application Number 10-2015-0105161 filed Jul. 24, 2015, the entire contents of which are incorporated herein for all purposes by this reference.

BACKGROUND OF THE INVENTION

Field of the Invention

The present invention relates to an intermediate phase continuous variable valve timing (hereafter, referred to as "CVVT") with an advance timing compensating system and a stopper and, more particularly, to an intermediate phase adjustment apparatus of an CVVT that always achieves self-lock regardless of the RPM of an engine and hydraulic conditions by balancing hydraulic pressure of an advancing chamber and a retarding chamber.

Description of the Related Art

In general, an CVVT is applied to a vehicle to reduce exhaust gas and improve fuel efficiency and output. Recently, intermediate phase CVVT systems for removing limits in response and operation area of the existing CVVT systems are increasingly being used. Intermediate phase CVVTs control the position of a cam not at the most advanced (intake) position and the most retarded (exhaust) position, but at an intermediate position, so response is quick and the use area of a cam can be increased, and accordingly, fuel efficiency is improved and exhaust gas is reduced.

In an intermediate phase CVVT, a lock pin on the rotor is locked into a lock pin hole between the advancing chamber and the retarding chamber while the RPM of an engine is reduced, thereby preparing for later engine start. The action that the lock pin is automatically locked into the lock pin hole while the RPM of an engine is reduced is called 'self-lock'. The self-lock is a function that allows an CVVT to mechanically return to an accurate position without specific adjustment so that operational stability of an engine can be maintained in periods where the CVVT system is not used, that is, when the engine is idling or is started.

In order to compensate for a difference in cam torque between advancing and retarding in self-lock, as shown in FIG. 1, a spring 50 is provided and a stopper 70 for controlling rotational amount of the spring 50 is additionally provided.

However, when the spring 50 and the stopper 70 are used, a difference Θ depending on the mounting position of the stopper 70 is generated maximally by 0.8 degrees, so a hydraulic pressure difference is generated between the advancing chamber 11 and the retarding chamber 13 due to a difference of an engine, a load difference of an advancing timing compensating system, and a mounting position difference of the stopper. Further, when the hydraulic pressure difference is too large, ensuring an intermediate position of a lock pin 80 for self-lock may be difficult.

Therefore, when control fails due to malfunction of a control unit, there is a need for an intermediate phase adjustment apparatus of an CVVT for balancing hydraulic pressure between an advancing chamber and a retarding chamber for self-lock of an CVVT.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

Accordingly, the present invention has been made keeping in mind the above problems occurring in the related art and/or other problems, and the present invention is intended to propose an intermediate phase adjustment apparatus for an CVVT for balancing hydraulic pressure between an advancing chamber and a retarding chamber for self-lock of an CVVT, when control fails due to a malfunction of a control unit.

In order to achieve the above object and/or other objects, according to one aspect of the present invention, there is provided an intermediate phase adjustment apparatus of an CVVT that includes: chambers including an advancing chamber and a retarding chamber formed between a rotor and a stator and supplied with oil through an oil channel; and a diverter valve balancing oil pressure between the chambers by sliding along an oil line through which the oil moves only in one direction between the chambers so that the oil selectively moves from a chamber having higher pressure to a chamber having lower pressure due to a pressure difference.

The oil channel for supplying the oil for operating the CVVT may be formed in the chamber, the diverter valve may be disposed between the oil line and the oil channel, and the oil line and the oil channel may be selectively opened or closed.

When pressured by hydraulic pressure, the diverter valve may block the oil line. When the hydraulic pressure is removed, the diverter valve may be returned by an elastic member coupled to the diverter valve and block the oil channel.

Outlets for discharging the oil to corresponding chambers may be formed at a first side of the oil line and check valves may be disposed at a second side of the oil line to prevent backward flow of oil.

The diverter valve may be disposed between the oil channel and the oil line for the oil to flow into one of the chambers.

The diverter valve may include a plurality of diverter valves, and each diverter valve may be provided for the oil to flow into a corresponding chamber.

The oil lines may include a plurality of oil lines that are fluidly connected to the chambers and connected to each other so that the oil moves to a pair of the chambers.

The oil lines may include a plurality of oil lines that are fluidly connected to the chambers and connected to each other so that the oil moves to a pair of the chambers; the diverter valve may include a plurality of diverter valves, each provided for the oil to flow into a corresponding chamber; the oil channel may include a plurality of oil channels; and the diverter valve may selectively open or close the oil lines and the oil channels to set an intermediate phase of the CVVT by balancing pressure between the chambers, thereby implementing self-lock.

The diverter valve may be composed of a head and a neck, and a groove may be formed inward around the head to reduce side force due to hydraulic pressure.

An elastic member may be provided for the diverter valve, and the diverter valve may be pressed by the elastic member when oil pressure applied to the diverter valve is removed.

According to the intermediate phase adjustment apparatus of an CVVT, a response speed for ensuring the intermediate phase of the CVVT increases, so a rapid response speed can be achieved when it is required to ensure an intermediate phase due to failure of an ECU and the configuration is simplified because a spring and a stopper can be removed. Further, it is possible to ensure a more accurate intermediate phase by overcoming an engine difference, a spring load difference, and a stopper mounting position difference. Accordingly, malfunctioning or stopping of an engine does not occur, even if there is a problem with the engine, so it is possible to ensure stability for operating the engine.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An intermediate phase adjustment apparatus of an CVVT according to exemplary embodiments of the present invention is described hereafter with reference to the accompanying drawings.

Figure 1:
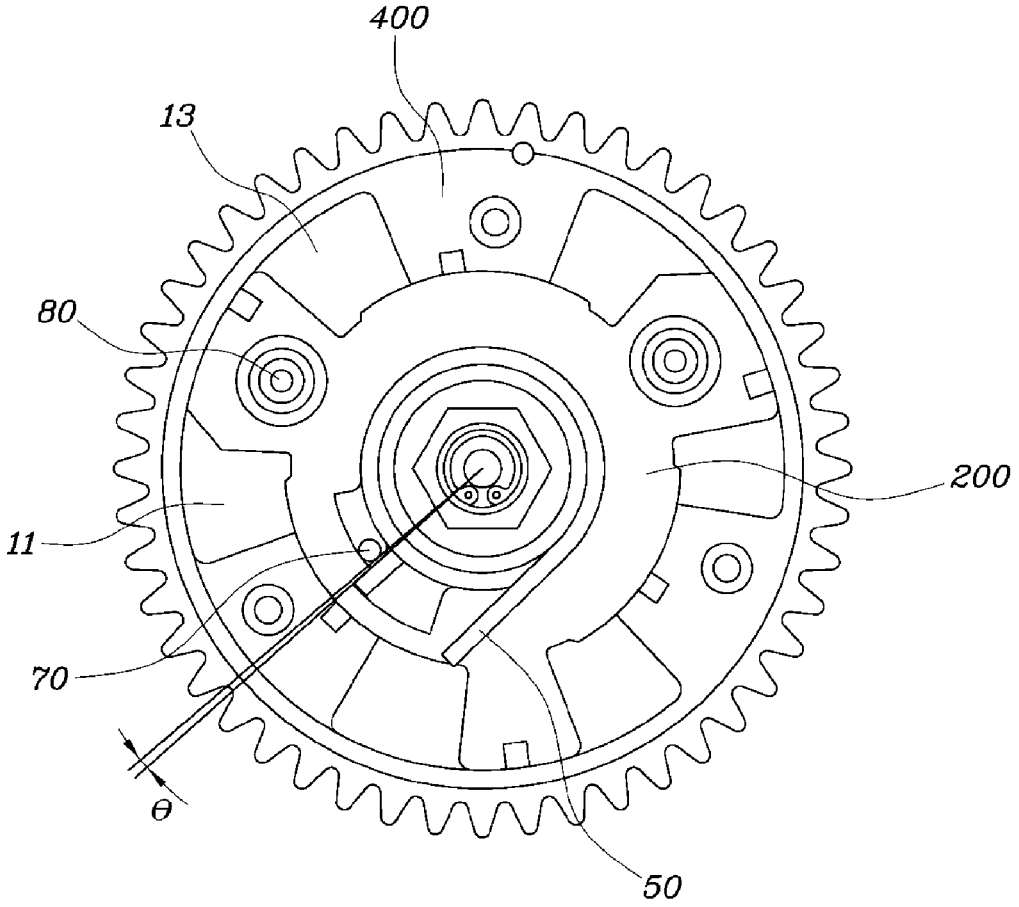
FIG. 1 Related Art
FIG. 1 is a view showing a difference in self-lock of the related art.
Figure 2:
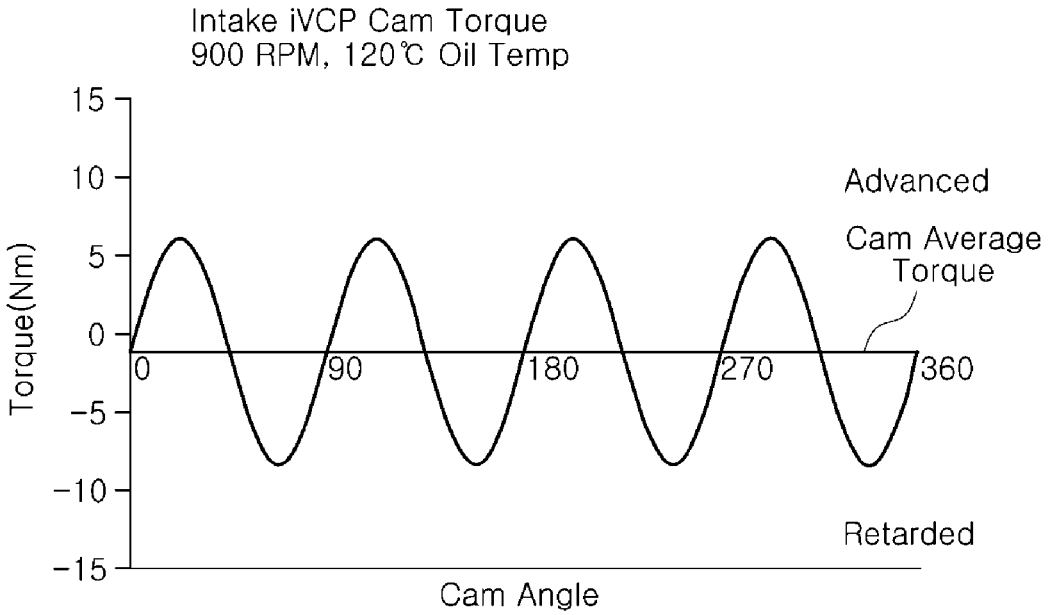
FIG. 2 is a graph showing cam torque.
Figure 3A:
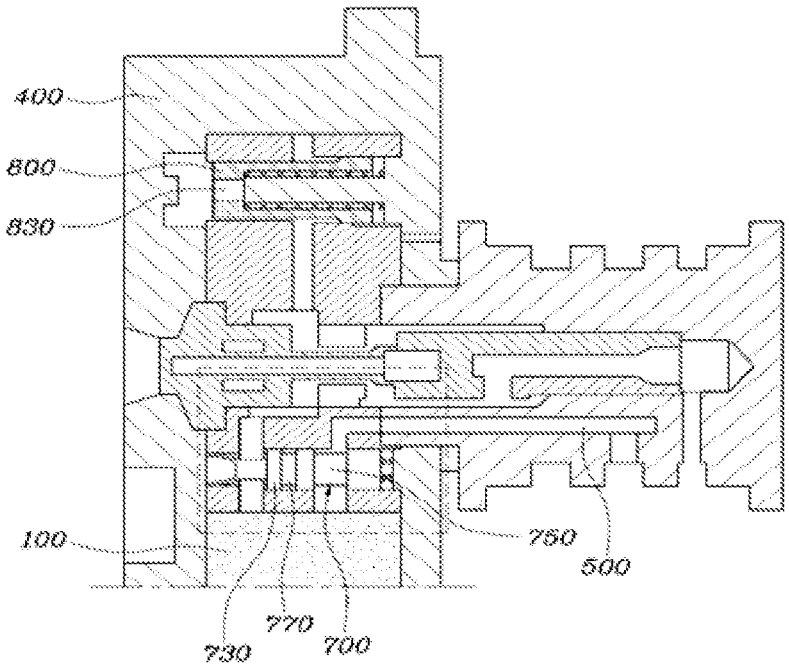
FIG. 3A is a view showing operation by an intermediate phase adjustment apparatus of an CVVT according to an embodiment of the present invention.
Figure 3B:
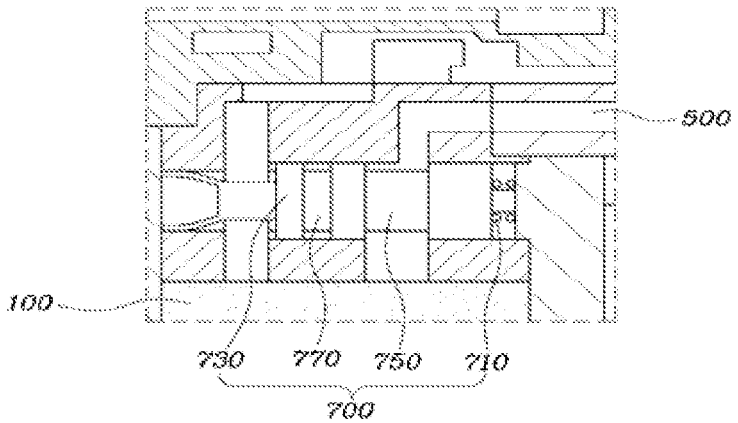
FIG. 3B is a partially enlarged view of FIG. 3A.
Figure 4A:
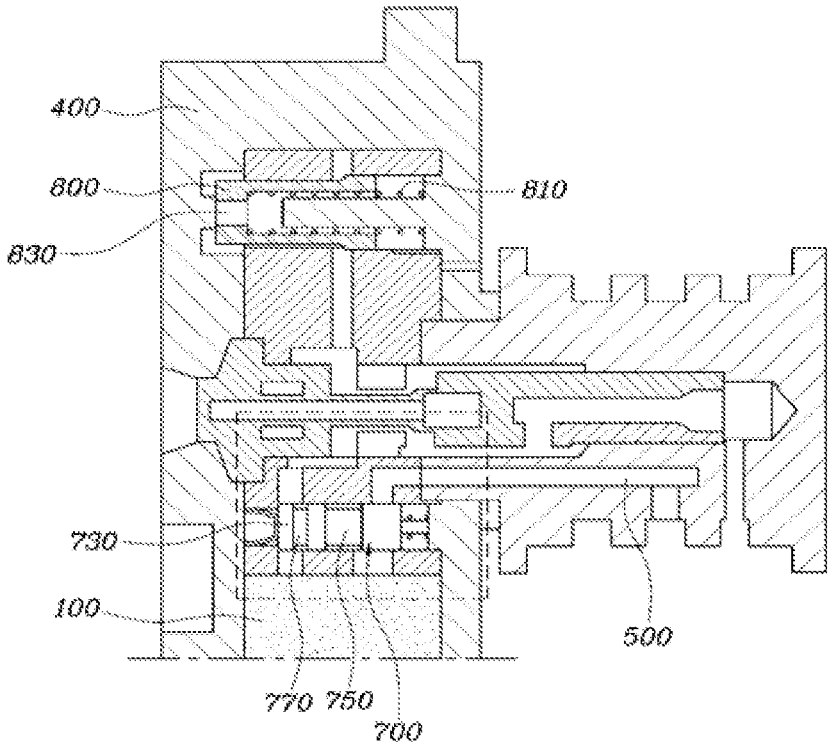
FIG. 4A is a view showing locking of a lock pin in FIG. 3A.
Figure 4B:
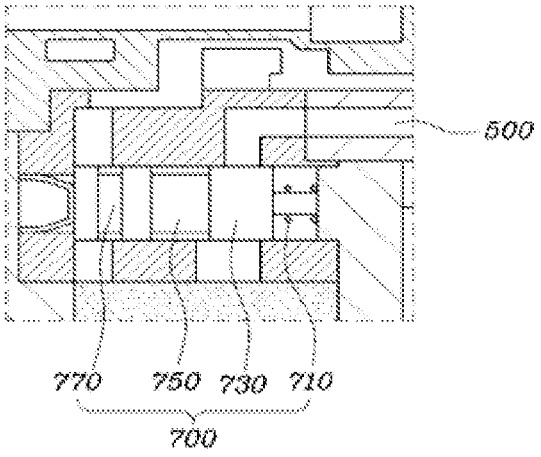
FIG. 4B is a partially enlarged view of FIG. 4A.
Figure 5:
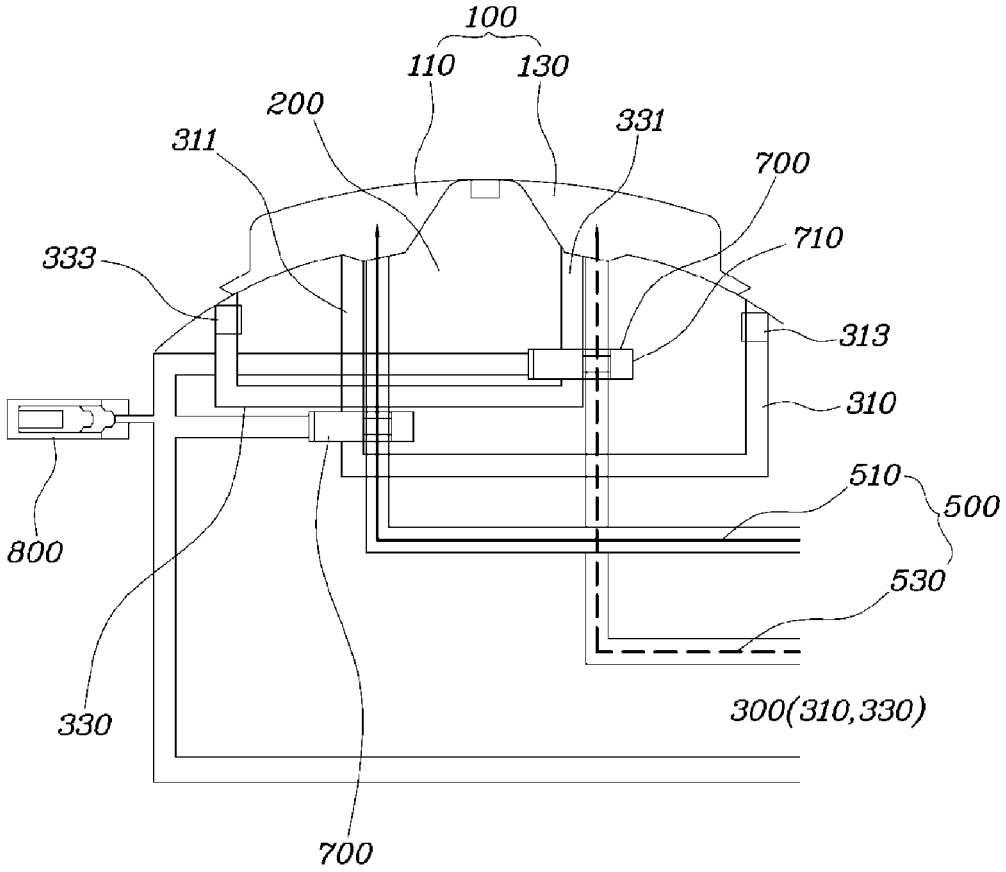
FIGS. 5 and 6 are views showing movement of oil in an CVVT.
Figure 6:
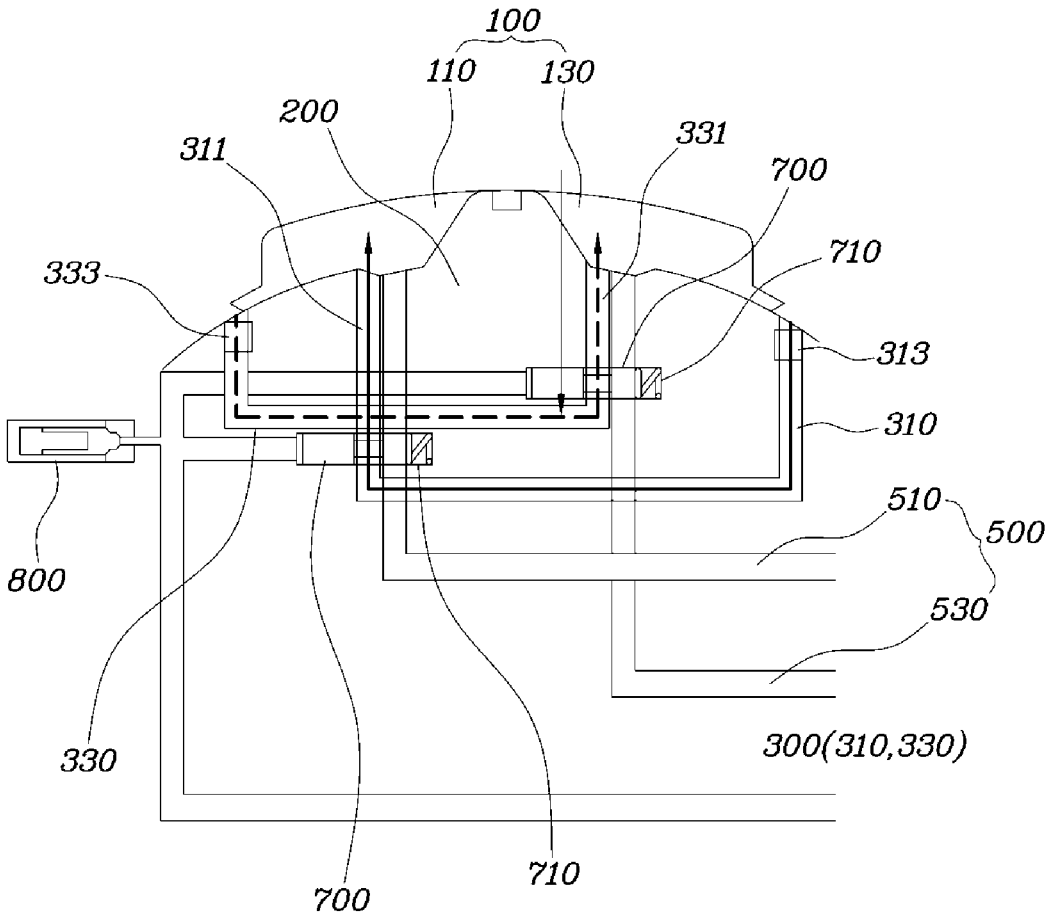
Figure 7:
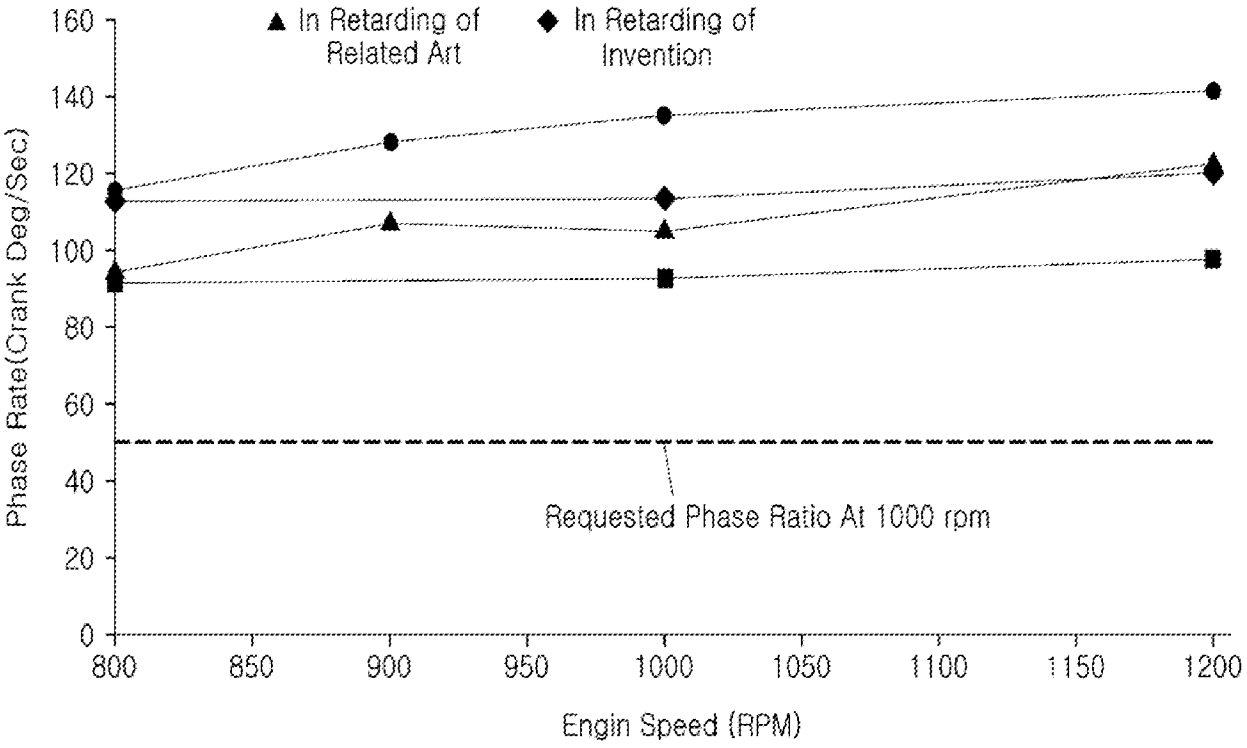
FIG. 7 is a graph comparing response speeds of an CVVT before and after the present invention is applied.

FIG. 2 is a graph showing cam torque, FIGS. 3A and 3B are views showing operation by an intermediate phase adjustment apparatus of an CVVT according to an embodiment of the present invention, and FIGS. 4A and 4B are views showing locking of a lock pin in FIG. 3A. FIGS. 5 and 6 are views showing movement of oil in an CVVT and FIG. 7 is a graph comparing response speeds of an CVVT before and after the present invention is applied.

An intermediate phase adjustment apparatus of an CVVT according to an embodiment of the present invention includes: an advancing chamber 110 and a retarding chamber 130 formed between a rotor 200 and a stator 400 and supplied with oil through an oil channel 500 (in some cases, the oil channel 500 includes oil channels 510 and/or 530); and a diverter valve 700 balancing oil pressure between the chambers 100 (e.g., 110 and 130) by sliding along an oil line 300 (in some cases, the oil line 300 includes 310 and/or 330) through which oil can move only in one direction between the chambers 100 so that oil selectively moves from a chamber having higher pressure to a chamber having lower pressure due to a pressure difference.

The diverter valve 700 is disposed between the oil channel 500 for supplying oil to the chambers 100 to operate the CVVT and the oil line 300 for oil to move between the chambers 100 and selectively opens/closes the oil line 300 and the oil channel 500. In detail, when hydraulic pressure is applied to the diverter valve 700, the oil line 300 is blocked by the diverter valve 700, and when the hydraulic pressure applied to the diverter valve 700 is removed, the diverter valve 700 is returned by an elastic member 710 coupled to the diverter valve 700 and the oil channel 500 is blocked.

The diverter valve 700 can be operated by a detent valve or an OCV and the operation of the diverter valve 700 will be described in detail below. In the oil line 300, outlets 311 and 331 through which oil is discharged to corresponding chambers may be formed at a first side and check valves 313 and 333 may be disposed at a second side to prevent backflow of oil.

The diverter valve 700 is composed of (or includes) a head 730 and a neck 750, and a groove 770 is formed inward around the head 730 to reduce side force due to hydraulic pressure. Further, the diverter valve 700 is disposed between the oil channel 500 and the oil line 300 for supplying oil to one chamber 100. In some cases, the diverter valve 700 may be provided for each of one or more chambers 100. The oil line 300 may also be provided for each of one or more chambers 100 and may be connected to each other so that oil is supplied to a pair of chambers 100 (e.g., one advancing chamber 110 and one retarding chamber 130 making a pair). Similarly, the diverter valve 700 may be provided for each of one or more chambers 100 and selectively open/close the oil line 300 and the oil channel 500 to adjust the intermediate phase of the CVVT by balancing pressure between the chambers 100. Accordingly, self-lock is achieved, and particularly, a difference is not generated when the intermediate phase is implemented, so an accurate intermediate phase can be achieved. Further, the diverter valve 700 may prevent backflow of oil when backflow cam torque is generated.

The operation of the diverter valve 700 is described in detail with reference to FIGS. 3A to 6. First, FIGS. 3A and 5 show the operation of the diverter valve 700 when the CVVT normally operates, in which oil is supplied from the OCV and pressure is applied to the diverter valve 700 by the oil pressure. Accordingly, oil is supplied to the retarding chamber 130 and the advancing chamber 110 through the oil channel 500. Further, oil is supplied to the lock pin 800 too, so the lock pin 800 is unlocked from a lock pin hole 830 by the oil pressure. That is, the diverter valve 700 is pressed by the oil pressure, the head 730 of the diverter valve 700 is positioned in the oil line 300, and the neck 750 is positioned in the oil channel 500. Accordingly, the oil line 300 is closed by the head 730 and the oil channel 500 is opened by the neck 750, so the oil supplied into the CVVT through a cylinder head is selectively supplied to the advancing chamber 130 and the retarding chamber 110, and accordingly, advancing or retarding of a cam can be performed.

In contrast, FIGS. 4A and 6 show the operation of the diverter valve 700 when self-lock needs to be achieved due to failure of an ECU, in which the oil pressure applied to the diverter valve 700 is removed. Then, the diverter valve 700 is pressed by the elastic member 710 coupled to the diverter valve 700, so it closes the oil channel 500 that has been normally operated and opens the oil line 300. That is, as the pressure applied to the diverter valve 700 is removed, the head 730 of the diverter valve 700 is moved to the oil channel 500 and the neck 750 is moved to the oil line 300, so the oil channel 500 is closed and the oil line 300 is opened. Accordingly, supply of the oil to the chambers 100 is stopped and the oil supplied to the chambers 100 moves from the chamber having higher pressure to the chamber having lower pressure through the oil line 300, so hydraulic pressure can be balanced between the chambers. That is, when the oil pressure in the advancing chamber 110 is higher than that of the retarding chamber 130, oil moves from the advancing chamber 110 to the retarding chamber 130 through an advancing oil line 310. On the other hand, when the oil pressure in the advancing chamber 110 is lower than that of the retarding chamber 130, oil moves from the retarding chamber 130 to the advancing chamber 110 through a retarding oil line 330. When an engine shakes, the intermediate phase can be ensured by repeating this operation. Accordingly, it is possible to ensure a more accurate intermediate phase of an CVVT without a difference in this way, and the oil pressure applied to the lock pin 800 is removed and the lock pin 800 is pressed and inserted into the lock pin hole 830 by the elastic member 810, so the lock pin 800 is locked.

Therefore, according to the intermediate phase adjustment apparatus of an CVVT, as shown in FIG. 7, a response speed for ensuring the intermediate phase of the CVVT increases, so a rapid response speed can be achieved when it is required to ensure an intermediate phase due to failure of an ECU and the configuration is simplified because a spring and a stopper can be removed. Further, it is possible to ensure a more accurate intermediate phase by overcoming an engine difference, a spring load difference, and a stopper mounting position difference. Accordingly, malfunctioning or stopping of an engine does not occur, even if there is a problem with the engine, so it is possible to ensure stability for operating the engine.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An intermediate phase adjustment apparatus of intermediate phase continuous variable valve timing (CVVT), the apparatus comprising:

chambers including an advancing chamber and a retarding chamber formed between a rotor and a stator and supplied with oil through an oil channel;

oil lines, each of which is connected to the advancing and retarding chambers, respectively, and, through which the oil flows only in one direction between the advancing and retarding chambers: and a diverter valve balancing oil pressure between the advancing and retarding chambers by sliding along the oil lines so that the oil selectively moves from the one of the advancing and retarding chambers having higher pressure to the another of the advancing and retarding chambers having lower pressure due to a pressure difference between the advancing chamber and the retarding chamber, wherein the diverter valve is configured to block the oil lines when a hydraulic pressure is applied to the diverter valve and to block the oil channel when the hydraulic pressure supplied applied to the diverter valve is removed.

2. The apparatus of claim 1, wherein the oil channel for supplying the oil for operating the CVVT is formed in the chambers, the diverter valve is disposed between the oil lines and the oil channel, and the oil lines and the oil channel are selectively opened or closed.

3. The apparatus of claim 1, wherein outlets for discharging the oil to the corresponding advancing and retarding chambers are formed at a first side of the oil lines and check valves are disposed at a second side of the oil lines to prevent backward flow of the oil.

4. The apparatus of claim 1, wherein the diverter valve is disposed between the oil channel and the oil lines for the oil to flow into one of the chambers.

5. The apparatus of claim 1, wherein the diverter valve includes a plurality of diverter valves, and each of the diverter valves is provided for the oil to flow into the corresponding advancing and retarding chambers.

6. The apparatus of claim 1, wherein the oil lines are fluidly connected to the chambers and connected to each other so that the oil moves to the pair of the advancing and retarding chambers.

7. The apparatus of claim 1, wherein:

the oil lines are fluidly connected to the chambers and connected to each of the oil lines so that the oil moves to the advancing and retarding chambers;

the diverter valve includes a plurality of diverter valves, each of the diverter valves provided for the oil to flow into the corresponding advancing and retarding chambers;

the oil channel includes a plurality of oil channels; and the diverter valve selectively opens or closes the oil lines and the oil channels to set an intermediate phase of the CVVT by balancing the oil pressure between the chambers, thereby implementing self-lock.

8. The apparatus of claim 1, wherein the diverter valve is composed of a head and a neck, and a groove is formed inward around the head to reduce side force due to the hydraulic pressure.

9. The apparatus of claim 1, wherein the oil channel and the oil lines are separately installed.

* * * * *